US007485821B2

(12) United States Patent
Martin

(10) Patent No.: US 7,485,821 B2
(45) Date of Patent: Feb. 3, 2009

(54) CONTROL ELEMENT WITH ANIMATED SYMBOLS

(75) Inventor: Michael Martin, Unsleben (DE)

(73) Assignee: PREH GmbH, Bad Neustadt a.d. Saale (DE)

( * ) Notice: Subject to any disclaimer, the term of this patent is extended or adjusted under 35 U.S.C. 154(b) by 0 days.

(21) Appl. No.: 11/453,051

(22) Filed: Jun. 15, 2006

(65) Prior Publication Data

US 2006/0265663 A1 Nov. 23, 2006

Related U.S. Application Data

(63) Continuation of application No. PCT/EP2004/014011, filed on Dec. 9, 2004.

(30) Foreign Application Priority Data

Dec. 15, 2003 (DE) ..... 103 58 945

(51) Int. Cl.
*H01H 9/00* (2006.01)

(52) U.S. Cl. ..... 200/310; 200/314

(58) Field of Classification Search ..... 200/310–315, 200/341–345; 341/22, 23, 28; 345/30, 156, 345/204, 168–173
See application file for complete search history.

(56) References Cited

U.S. PATENT DOCUMENTS

| | | | | |
|---|---|---|---|---|
| 4,501,937 | A | 2/1985 | Anderson et al. | |
| 5,278,362 | A | 1/1994 | Ohashi | |
| 5,777,603 | A | 7/1998 | Jaeger | |
| 5,861,589 | A * | 1/1999 | Sato et al. | 200/5 R |
| 6,087,601 | A * | 7/2000 | Callender et al. | 200/5 A |
| 6,198,061 | B1 | 3/2001 | Amari | |
| 6,407,663 | B1 * | 6/2002 | Huggett | 340/461 |
| 6,534,163 | B1 * | 3/2003 | Takatsu | 428/212 |
| 7,084,360 | B2 * | 8/2006 | Schmidt et al. | 200/5 R |
| 7,202,431 | B2 * | 4/2007 | Gauzin | 200/339 |
| 2001/0019013 | A1 * | 9/2001 | Weber et al. | 200/309 |
| 2006/0021865 | A1 * | 2/2006 | Gauzin | 200/339 |

FOREIGN PATENT DOCUMENTS

DE 40 18 411 A1 2/1991

(Continued)

OTHER PUBLICATIONS

Horst-Robert Fickel et al., "MFT 1632 with built-in LCD: The key to safer control." Electromechanical Components, Siemens AG, Munich, DE, vol. 27, No. 6, Nov. 1, 1992, pp. 24-27; XP000328748. ISSN: 0945-1137.

*Primary Examiner*—Michael A Friedhofer
*Assistant Examiner*—Lisa N Klaus
(74) *Attorney, Agent, or Firm*—Muncy, Geissler, Olds & Lowe, PLLC

(57) ABSTRACT

A control element for an electric control device is disclosed that includes a freely programmable symbolic system, whereby the symbols are projected into a side of the control element that is facing away from the operator by a controllable display unit and an illuminating device arranged in front thereof, or by a controllable display unit and an optics, or by a controllable display unit and a light guide, and whereby the symbols are made visible by a transmissive layer on the side of the control element that faces the operator, whereby alternating symbols are generated in the display unit.

8 Claims, 2 Drawing Sheets

FOREIGN PATENT DOCUMENTS

| | | | |
|---|---|---|---|
| DE | 44 26 669 | A1 | 3/1995 |
| DE | 198 09 934 | A1 | 9/1999 |
| DE | 198 49 973 | A1 | 5/2000 |
| DE | 100 08 670 | A1 | 9/2000 |
| DE | 103 42 142 | A1 | 4/2005 |
| EP | 0 232 137 | A2 | 8/1987 |
| EP | 0 463 285 | A1 | 1/1992 |
| EP | 1 146 490 | A2 | 10/2001 |
| JP | 60044857 | A | 3/1985 |
| JP | 11-265158 | | 9/1999 |

* cited by examiner

CONTROL ELEMENT WITH ANIMATED SYMBOLS

This nonprovisional application is a continuation of International Application No. PCT/EP2004/014011, which was filed on Dec. 9, 2004, and which claims priority to German Patent Application No. DE 103 58 945, which was filed in Germany on Dec. 15, 2003, and which are both herein incorporated by reference.

BACKGROUND OF THE INVENTION

1. Field of the Invention

The present invention relates to a control element for an electric control device having a freely programmable symbolic system, whereby the symbols are projected into a side of the control element, which is facing away from the user, by a controllable display unit and an illuminating device arranged in front thereof, or by a controllable display unit and optics, or by a controllable display unit and a light guide, and the symbols are made visible by a transmissive layer on the side of the control element that faces the user. Furthermore, the invention is directed to a method for generating freely programmable symbols on the control element of an electric control device, whereby symbols are projected into the interior face of the control element by an illuminating device and a controllable display unit, or by a controllable display unit and optics, or by a controllable display unit and a light guide, and whereby the generated symbols are transmitted via a transmissive layer on and in the control element to a surface facing the user so that the user can recognize a symbol corresponding to the function of the control element.

Although the control element can be used in any kind of control device, for example, in control devices for motor vehicles, input devices for cash registers etc., the present invention and its objectives are described with reference to a control device in a motor vehicle.

2. Description of the Background Art

To control the multiple functions in a motor vehicle, control devices are most frequently installed in the center console or the dashboard. These control devices are then provided with control elements, some of which can control various functions. To avoid having to provide a multi-function control element, that is, a control element, to which various functions are allocated, with a plurality of symbols, it is known from the published patent application DE 103 42 142, which is assigned to the Applicant of the present invention, to provide control elements with freely programmable symbols. An image is hereby generated in a controllable display unit, for example, an LCD display unit, which is projected onto an image plane in the control element so that it becomes visible to an observer of the control element from the front. By using a freely programmable display unit, any desired symbol can thereby be generated on the surface of the control element.

A plurality of corresponding methods and devices are described in the publication (DE 103 42 142), which make it possible to project an image of the symbols generated in the display unit as positive or negative. In a first embodiment, a control element is described, in which a display unit is impacted with parallel light by an illuminating device, which is arranged behind an optical system, for example, a lens. Depending on the generated symbols, there are transmissive or absorbing areas in the display unit so that the display unit serves as a transmission filter. The light rays penetrating the display unit form the image of the symbols on the inner surface of the control element. The control element itself is made of a translucent material so that the generated symbols become visible on the side of the control element that faces the operator. In order to control the configuration and the behavior of the ray in the control element, and to be able to provide an exact image on the control element, various embodiments comprising illuminating units, display units, optics and fiber materials are described in the publication, whereby the dynamic movements of the control element during actuation are also taken into consideration. The described system makes it thus possible to display to the user different symbols on the surface of the control element, depending on the function designated to the control element.

DE 100 08 670 C2, which corresponds to U.S. Pat. No. 6,198,061, also discloses a device for displaying various symbols on a control element. An image guide, which guides the information presented on the screen of the indicator unit close to a switch cap, is provided between the indicator unit and the switch cap. With the conventional switch arrangement, if a plurality of functions is assigned to the switch cap, the information displayed on the screen of the indicator unit is altered in correspondence with a function change so that the symbol of the switch cap changes accordingly to allow a multiple display on one single switch cap.

SUMMARY OF THE INVENTION

It is therefore an object of the present invention to provide an electric control device of simple construction having a freely programmable symbolic system, which makes it possible to provide the operator with a positive image of the selected function. Furthermore, a method is disclosed, which provides the user with an unequivocal and positive identification of the available function as well as the selected function.

Alternating symbols are generated in the display unit of an electric control device. As a result of the basic idea of the invention, it is now possible to display symbols on the control element, which with simple structural means clearly explain the function. The alternating symbols can thereby represent a motion, for example, so that the available function, or the selected function, becomes instantly visible to the user. The technical solution for the method aspect of the invention is found by generating animated symbols on the surface of the control element via symbols that are alternatingly generated in the display unit. It is thus possible not only to illustrate the function, but it is also possible to describe the function. Since the invention can be utilized with conventional systems, a structurally simple and thus economical realization of the invention is provided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein the single figure illustrates a control element for a motor vehicle with a plurality of control elements, according to an embodiment of the invention.

DETAILED DESCRIPTION

Figure 1:
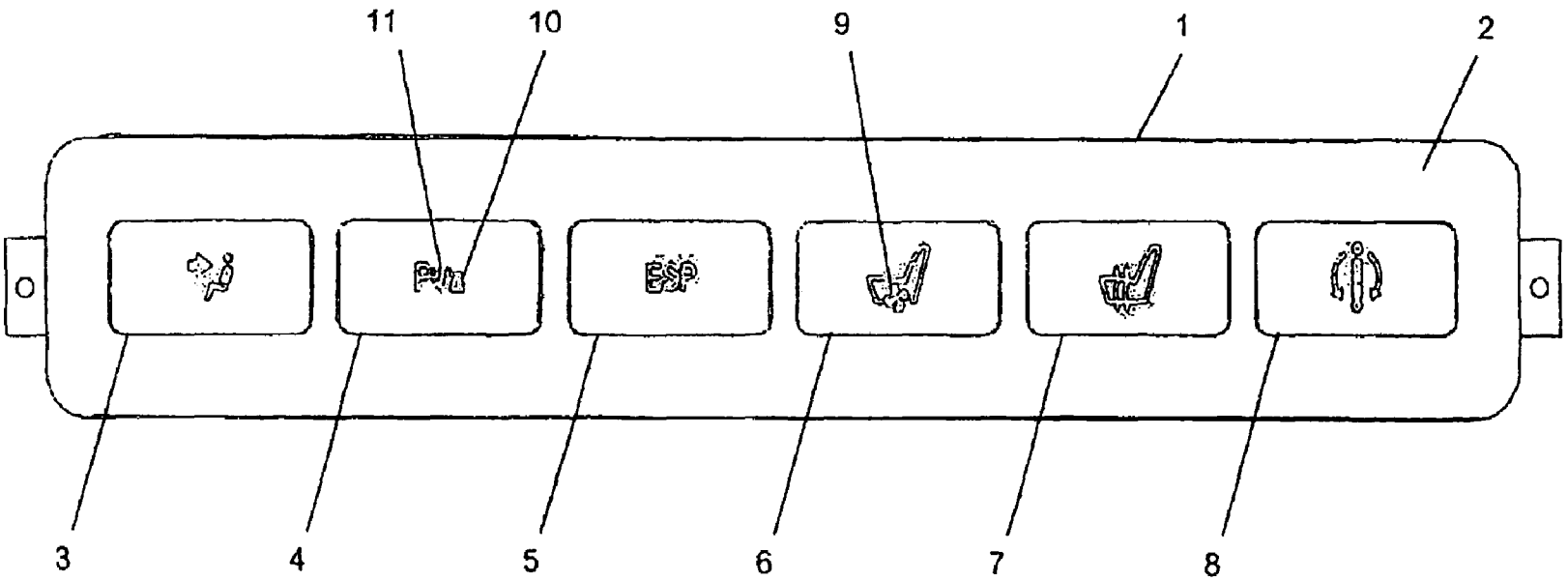
FIG. 1 illustrates a control element according to an example embodiment of the present invention.

FIG. 1 illustrates a control element 1, as is commonly used in motor vehicles, in a front view, that is, the side facing the operator. The control element 1 is comprised of a frame part 2, which houses the control elements 3, 4, 5, 6, 7, and 8. The frame part 2 can be inserted in the dashboard of a motor vehicle, for example. The control elements 3 to 8 can all be configured as freely programmable control elements. Thus making it possible to display a different function with a different symbol on each of the control elements 3 to 8.

Symbols are to be understood as alphanumerical characters, numeric characters, numbers, symbols, or even pictograms. It goes without saying, of course, that a combination of alphanumerical characters, numeric characters, numbers, symbols, or pictograms can also be displayed. A combination of several symbols or pictograms is conceivable as well.

The exemplary illustration of control element 6, which represents a seat air conditioning system, shows in more detail how the control element 6 of the present invention is displayed to the user. In an off-position, the control element 6 indicates to the operator of the motor vehicle that the seat air conditioning can be turned on by activating this control element 6. Not only can the function illumination of this common function be intensified, but an animated symbol can be displayed on the surface of the control element as well when the control element 6 is activated. It is hereby conceivable, for example, that with alternating symbols showing different positions of the fan blade 9, it is suggested to the operator that the fan blade is in motion, that is, is oscillating. This provides the operator with a visual confirmation that the seat air conditioning is turned on. This can be of particular advantage when due to incident light, for example, sun light, a positive differentiation between search illumination and function illumination in the control elements is not possible. An additional advantage is that an animated symbol is always easier to recognize, which makes it substantially easier for the operator to monitor the often large array of control elements in the motor vehicle.

Control element 4 symbolizes a distance control, which can be activated when parking, for example. With such a control element 4 in particular, the use of an animated symbol can be of great importance and is a further benefit of the present invention. When various symbols not only indicate that the distance control is activated, but also indicate the actual distance by displaying different symbols, which, for example, can also show different distances between the displayed P and the obstacle 10, a visual impression can be transmitted to the operator as to how close the vehicle is to the obstacle 10. A further benefit of the present invention is realized when color-changing symbols are generated by a color-changeable display unit. For example, in the control element 4 described above, the space between the vehicle P to be parked and the obstacle 10 could be more clearly indicated by displaying the imaged radio signals 11 in different colors. It is thus conceivable, for example, to initially display the first strip of the radio signal in one color when approaching the obstacle 10, and to color-code the second, and finally the third stripe of the radio signal 11 when closing in on the obstacle 10. This would make it considerably easier for the operator to move his/her vehicle towards the obstacle 10, or to maneuver the vehicle.

With regard to the heating system, which is illustrated in control element 7 as a seat heating system, it is possible, for example, to show the temperature fluctuations during the warm-up period of the vehicle in color. For example, immediately after the motor vehicle is started and the seat heating system is directly actuated, the temperature of the air introduced into the seat could be visually indicated, whereby the arrows appear first in blue, for cold air, and subsequently in red, for warm air. This color-coded cold and hot identification can be of particular benefit when, as is commonplace in motor vehicles these days, the cooling vents are integrated in glove compartments or separate placement areas. It would then be very easy for the operator to see that the air conditioning was not functioning in this subarea because the blue symbol indicating cold air, for example, could appear in a different color.

It is explicitly noted that the number of different symbols to be displayed on control elements 3 to 8 is not limited in any way. The movement of fan blade 9 in control element 6, for example, can be displayed in a plurality of possible positions of the fan blade. The approach of obstacle 10 by the vehicle, as illustrated in control element 4 and explained in the description, is also not limited to a number of possible symbol images. Rather, it is even conceivable to select a reasonable number of appropriate symbols to make it easy for the operator to observe the approach of the obstacle by the motor vehicle in a movie-like fashion.

By using a black translucent material for the control element, either the symbol itself of the surface surrounding the symbol can be illuminated, in accordance with the present invention. In this way, and with a combination of animated and alternating images, it is very easy to alert the operator of the motor vehicle to a warning function, for example, or to clarify a menu sequence.

Figure 2:
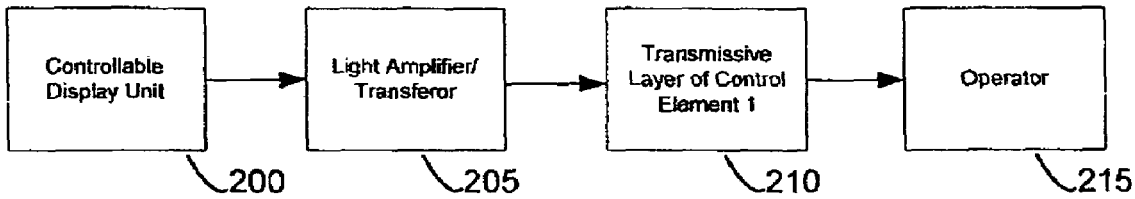
FIG. 2 illustrates a freely programmable symbolic system according to an example embodiment of the present invention.

FIG. 2 illustrates a freely programmable symbolic system according to an example embodiment of the present invention. As shown in FIG. 2, the freely programmable symbolic system includes a controllable display unit 200, a light amplifier/transferor 205, a transmissive layer 210 and an operator 215. The controllable display unit 200 may be, for example, a liquid crystal display (LCD) unit. The light amplifier/transferor 205 may be embodied in any number of ways, including but not limited to an illuminating device (e.g., a backlight), optics and/or a light guide. The transmissive layer may be, for example, a glass or plastic screen on the control element 1, as is illustrated in FIG. 1 as control elements 3,4,5,6,etc. The operator 215 is simply indicative of a user (e.g., a driver of a motor vehicle). Accordingly, the controllable display unit 200 may generate a symbol (e.g., one or more graphic images), which may be output and transferred/amplified by the light amplifier/transferor 205. The light may pass through the transmissive layer 210 within the control element 1, and may thereafter be output to the operator 215, where the displayed image may be viewed.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A control element for an electric control device comprising:

a freely programmable symbolic system in which symbols are projected into a side of the control element that is facing away from an operator by a controllable display unit and an illuminating device arranged in front of the controllable display unit, or by the controllable display unit and optics, or by the controllable display unit and a light guide, and the symbols are made visible by way of a transmissive layer in the control element on the side facing the operator, wherein alternating symbols are generated in the display unit.

2. The control element according to claim 1, wherein colored or color-changing symbols are generated by at least one color-changeable display unit.

3. The control element according to claim 1, wherein colored or color-changing symbols are generated by the illuminating device which projects different colors.

4. The control element according to claim 1, wherein the control element is made of a black translucent material.

5. A method for generating a freely programmable symbolic system on a control element of an electric control device, the method comprising the steps of:

projecting symbols into an interior face of the control element by an illuminating device and a controllable display unit, or by the controllable display unit and optics, or by the controllable display unit and a light guide;

transmitting the generated symbols via a transmissive layer towards the control element to a surface facing an operator; and generating animated symbols are on the surface of the control element by symbols, which are alternatingly generated in the controllable display unit, on a side of the control element that faces the operator.

6. The method according to claim 5, wherein color-changing symbols are generated.

7. A method of displaying a programmable control function, comprising:

outputting, from a control element including a transmissive element, a sequence of images associated with the programmable control function, each of the sequence of images being alternatingly output from the, control element via the transmissive element to an operator to convey information associated with the programmable control function.

8. An electric control device comprising:

a control element including a transmissive element, the control element outputting a sequence of images associated with the programmable control function, each of the sequence of images being alternatingly output from the control element via the transmissive element to an operator to convey information associated with the programmable control function.

* * * * *